United States Patent [19]

Nakamura et al.

[11] Patent Number: 4,563,978

[45] Date of Patent: Jan. 14, 1986

[54] DEVELOPING APPARATUS

[75] Inventors: Shunji Nakamura, Kawasaki; Fumitaka Kan, Yokohama; Hidemi Egami, Zama; Atsushi Hosoi, Tokyo; Hatsuo Tajima, Matsudo; Kimio Nakahata, Kawasaki, all of Japan

[73] Assignee: Canon Kabushiki Kaisha, Tokyo, Japan

[21] Appl. No.: 594,863

[22] Filed: Mar. 29, 1984

[30] Foreign Application Priority Data

| | | | |
|---|---|---|---|
| Apr. 8, 1983 | [JP] | Japan | 58-61852 |
| Apr. 8, 1983 | [JP] | Japan | 58-61854 |
| Apr. 8, 1983 | [JP] | Japan | 58-61855 |
| Apr. 18, 1983 | [JP] | Japan | 58-68645 |

[51] Int. Cl.[4] ..... G03G 15/09

[52] U.S. Cl. ..... 118/658; 355/3 DD

[58] Field of Search ..... 118/658; 355/3 DD

[56] References Cited

U.S. PATENT DOCUMENTS

| | | | |
|---|---|---|---|
| 4,350,440 | 9/1982 | Watanabe | 118/658 X |
| 4,365,586 | 12/1982 | Hosono et al. | 118/658 X |
| 4,377,332 | 3/1983 | Tamura | 118/658 X |
| 4,406,535 | 9/1983 | Sakamoto et al. | 118/658 X |

*Primary Examiner*—Bernard D. Pianalto

*Attorney, Agent, or Firm*—Fitzpatrick, Cella, Harper & Scinto

[57] ABSTRACT

A developing apparatus includes a container for containing a non-magnetic developer and magnetic particles, a developer carrier for carrying the non-magnetic developer toward an image bearing member, a regulating member located adjacent to the non-magnetic developer discharge opening of the container to form a gap between the surface of the carrier and the regulating member, and a magnet positioned adjacent to the carrier at the side of the carrier opposite to the regulating member and causing the magnetic particles to form a magnetic brush upstream of the regulating member adjacent to the developer discharge opening of the container with respect to the direction in which the developer carrier is moved, whereby a thin layer of the non-magnetic developer can be formed on the developer carrier.

20 Claims, 18 Drawing Figures

DEVELOPING APPARATUS

BACKGROUND OF THE INVENTION

1. Field of the Invention

The present invention relates to a developing apparatus for developing a latent image with a non-magnetic developer.

2. Description of the Prior Art

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent device for the improved sharpness, resolution or the other qualities has necessitated the achievement of the system for forming a thin layer of one-component dry developer.

A method of forming a thin layer of one-component dry developer has been proposed in U.S. Pat. Nos. 4,386,577 and 4,387,664 and this has been put into practice. However, this is the formation of a thin layer of a magnetic developer, not of a non-magnetic developer. The particles of a magnetic developer must each contain a magnetic material to gain a magnetic nature. This is disadvantageous since it results in poor image fixing when the developed image is fixed of a transfer material, also in poor reproducibility of color (because on the magnetic material, which is usually black, contained in the developer particle).

Therefore, there has been proposed a method wherein the developer is applied by cylindrical soft brush made of, for example, beaver fur, or a method wherein the developer is applied by a doctor blade to a developer roller having a textile surface, such as a velvet, as to a formation of non-magnetic developer thin layer. In case where the textile brush is used with a resilient material blade, it would be possible to regulate the amount of the developer applied, but the applied toner layer is not uniform in thickness. Moreover, the blade only rubs the brush so that the developer particles are not charged, resulting in foggy images. Additionally, it was difficult to prevent the leakage of the developer from the apparatus, since it contains non-magnetic developer particles, which are not influenced by magnetic field.

SUMMARY OF THE INVENTION

It is, therefore, a principal object of the present invention to provide a developing apparatus wherein a thin layer, having a uniform thickness, of non-magnetic developer is formed on the developer carrier surface.

Another object of the present invention is to provide a developing apparatus wherein the non-magnetic developer particles are triboelectrically charged to a sufficient extent and coated on the developer carrier surface.

A further object of the present invention is to provide a developing apparatus which is applicable to a multicolor development with faithful color reproducibility.

A further object of the present invention is to provide a developing apparatus which can utilize a non-magnetic developer having better fixativeness.

A further object of the present invention is to provide a developing apparatus which can effectively prevent the leakage of the non-magnetic developer there- from.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Figure 1:
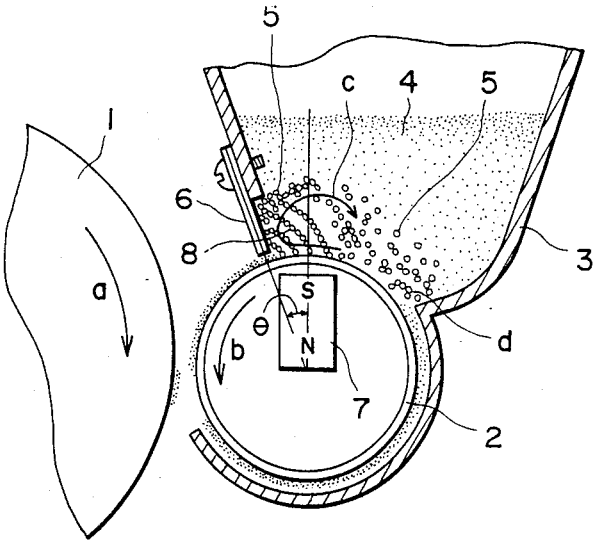
FIG. 1 is a cross-sectional view of a developing apparatus, illustrating the principle of the present invention.

FIG. 1 shows the cross-section of the developing apparatus to illustrate the principle of the development operation. The apparatus comprises an electrophotographic photosensitive drum 1 as an image bearing member which bears a latent image formed by an unshown latent image forming means. It is rotatable in the direction shown by arrow a passing through the developing station, where a non-magnetic sleeve 2, as a developer carrier for carrying a developer, is faced thereto with a predetermined gap or clearance. The sleeve 2 rotates in the direction shown by arrow b. Above the sleeve 2 is a developer container, made of non-magnetic material such as resin or aluminium, for containing a mixture of non-magnetic developer particles 4 and magnetic particles 5. The developer container 3 has, at its downstream side with respect to movement of the sleeve 2, a magnetic blade 6 screwed to the container 3 as a means for regulating the supply of the non-magnetic developer to the developing station.

Across the sleeve 2, a magnet 7 is provided as a magnetic field generating means. The position of the magnet 7 is determined in connection with the position of a magnetic pole S and the position of the magnetic blade 6, and practically, the pole S is positioned slightly upstream of the magnetic blade 6 position. This arrangement provides better prevention of magnetic particle leakage through the clearance between the magnetic blade 6 and the sleeve 2 surface and better application of the non-magnetic developer onto the sleeve 2 surface.

In the above arrangement, the magnetic particles within the container 3 forms a magnetic brush by the magnetic field formed between the magnetic pole S of the magnet 7 and the magnetic blade 6. Upon rotation of the sleeve 2, magnetic particles and non-magnetic developer are mixed and stirred, while the magnetic brush 8 is kept formed. In the neighborhood of the magnetic blade 6, the mixture of non-magnetic developer and magnetic particles are stopped by the magnetic blade 6 so that the mixture moves upwardly and circulates as shown by arrow c.

The non-magnetic developer is charged triboelectrically by the friction with the sleeve 2 and/or the magnetic particles. The charged developer is limited in the amount of passage by the magnetic brush 8 of the magnetic particles formed in the neighborhood of the magnetic blade 6 and uniformly coated on the sleeve 2 by the image force as a thin layer of non-magnetic developer and conveyed to a developing station where it is faced to the photosensitive drum 1.

The magnetic particles 5 constituting the magnetic brush 8 is prevented from going out through the clearance between the magnetic blade and the sleeve 2, by setting the confining force of the magnetic field by the magnet 7 to be larger than conveying force caused by the friction between the sleeve 2 and the magnetic particles 5. And, when the magnetic brush contains non-magnetic developer, the content of the developer in this brush is maintained constant by the rotation of the sleeve 2, so that the consumption of the developer is automatically compensated by the non-magnetic developer supplied to the magnetic brush 8. Thus, a constant amount of the non-magnetic developer is coated on the sleeve 2.

In the foregoing explanation of the principal mechanism, the regulating member is a magnetic blade. However, non-magnetic blade or a non-magnetic wall of the container 3 made of a resin or aluminium can be used as the regulating member. In those cases, the clearance between the blade 6 and the sleeve 2 is required to be smaller than when the magnetic blade is used. The use of the magnetic blade is preferable in that the magnetic field formed between the blade and the magnetic pole is effective to form a stable magnetic brush at the outlet of the developer.

The formation of thin layer from the above non-magnetic developer is described in more detail in U.S. patent Ser. Nos. 466,547 and 527,397 filed under the name of the same assignee. Therefore, the further description thereof will be omitted.

In the developing apparatus shown in FIG. 1, the non-magnetic developer tends to leak at a region d at which the sleeve 2 returns the container 3. In order to prevent such a leakage of the non-magnetic developer at the above region d, the present invention provides a magnetic brush formed between the sleeve and the container at the above region d. The magnetic particles can be also prevented from leaking at the region d.

The invention will be described in more detail with reference to the drawings.

Figure 2:
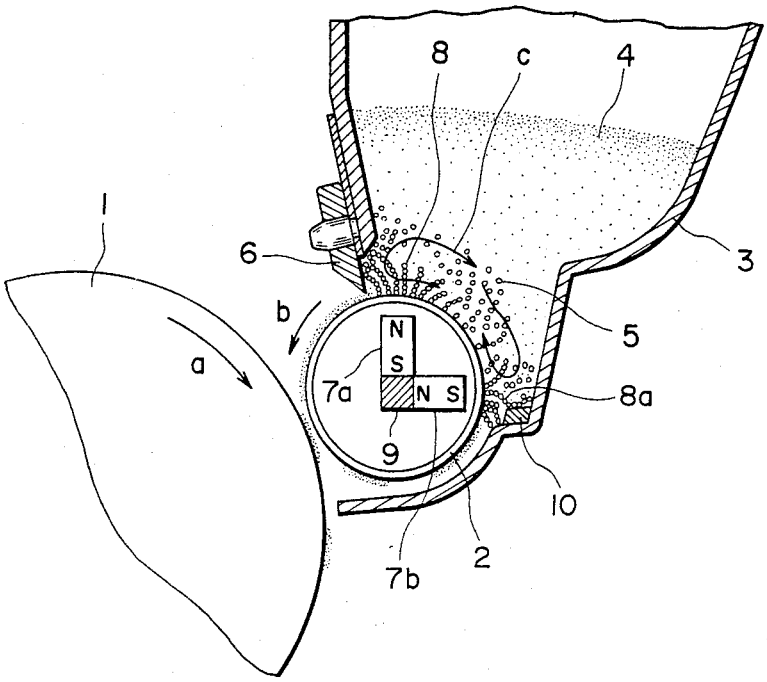
FIG. 2 is a cross-sectional view of a developing apparatus to which the present invention is applied.

FIG. 2 shows one embodiment of the present invention in which the same reference numerals are assigned to the means or elements having the similar functions as with FIG. 1 apparatus.

Referring to FIG. 2, there is shown a first fixed magnet 7*a* which is mounted on a fixed shaft 9 within the sleeve 2 and has a first magnetic pole which functions to provide the same action as that of the magnet 7 shown in FIG. 1, that is, to form a magnetic brush adjacent to the magnetic blade. A second fixed magnet 7*b* is also provided and has a second magnetic pole which provides the polarity, for example, south pole S, opposite to the first magnetic pole, at a position adjacent to the inner wall of the sleeve 2. The inner wall of the container 3 opposing to the second magnet 7*b* supports a magnetic member, such as an iron piece 10.

In the above arrangement, the magnetic particles 5, which are present in a great amount adjacent to the surface of the sleeve 2, are circulated in the direction of arrow c while forming magnetic brushes at the respective magnetic poles, under the actions of the magnetic fields and the rotation of the sleeve 2. More particularly, the magnetic particles 8 collide against inner side of the magnetic blade 6 or the container wall and then are pushed upwardly by the movement of the other magnetic particles being carried from upstream part. The magnetic particles are then moved downwardly toward the bottom of the container under gravity until they are back to the surface of sleeve 2 at the first magnet N position, they, while making the above movement, take the non-magnetic developer among themselves.

Thus, the magnetic particles always exist and circulate in the neighborhood of the bottom of the container to form a magnetic brush 8*a* between the sleeve 2 and the container 3 and/or the iron piece 10 under the influence of the second magnet 7*b*. This magnetic brush 8*a* can prevent the developer 4 from leaking out of the container 3 beyond the magnetic brush 8*a*. Because this magnetic brush is formed independently of the operation of the developing apparatus, this magnetic brush 8*a* can also prevent the magnetic particles as well as the developer from leaking out of the container even when the developing apparatus is inoperative. It is of course that the magnetic brush 8 created adjacent to the magnetic blade 6 under the influence of the magnetic pole N of the first magnet prevents the magnetic particles as well as the developer similarly from leaking out of the container unnecessarily.

The magnetic brush 8*a* may be formed only between the wall of the container 3 and the sleeve 2 or between the iron piece 10 and the sleeve 2 as shown in FIG. 2. If the magnetic member such as the iron piece is used as described above, the magnetic field is created more strongly and stably in co-operation with the second magnetic pole S, even when the sleeve 2 rotates.

The movement of the developer on the sleeve will be described in connection with the positional relationship between the second magnetic pole S and the magnetic member.

Figure 3A:
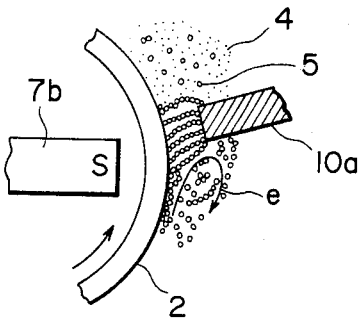
FIGS. 3A and 3B illustrate the state of a magnetic brush on the basis of a relationship between a second magnetic pole and a magnetic member.
Figure 3B:
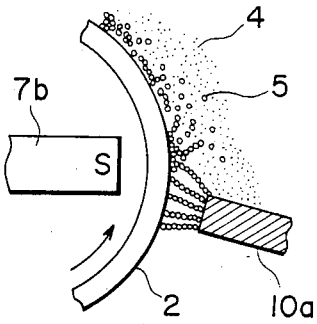

FIG. 3A shows an arrangement where the second magnetic pole (S pole) is located upstream of the magnetic member or iron piece 10*a* in the direction of movement of the sleeve 2, while FIG. 3B shows another arrangement in which the second magnetic pole S is positioned downstream of the iron piece 10*a* in the same direction.

As seen from FIG. 3A, the magnetic brush may concentrically be formed upstream of the iron piece 10*a* if the second magnetic pole S is located upstream of the iron piece 10*a*. As a result, a portion of the brush upstream of the iron piece 10*a* may make a circulation as shown by arrow e in FIG. 3A, depending on the amount of the magnetic particles. In such an event, the developer which remains on the sleeve 2 without being consumed upon development and carried back to the second magnetic pole S tends to be scraped out by the moving magnetic brush. The scraped developer falls to under the sleeve 2 and is scattered to contaminate the circumference. It is therefore preferable not to provide such a space as to maintain the magnetic particles upstream of the iron piece 10*a* if the second magnetic pole S is positioned upstream of the iron piece 10*a* as above-mentioned.

In the arrangement shown in FIG. 3B, the magnetic brush will concentrically be formed downstream of the iron piece 10*a*. Consequently, no circulation of the magnetic particles is produced in the magnetic brush upstream of the iron piece 10*a*. Thus, the developer portion remaining on the sleeve 2 can smoothly enter the container. Furthermore, the magnetic brush does not readily move with the rotating sleeve 2, and more positive and stable retention of the developer within the container is provided, because the magnetic brush is formed between the sleeve 2 and the iron piece 10*a* under the influence of the strong magnetic field.

It is therefore preferable that the magnetic member is positioned at or downstream of the second magnetic pole in the direction of movement of the sleeve.

EXAMPLE

Figure 4:
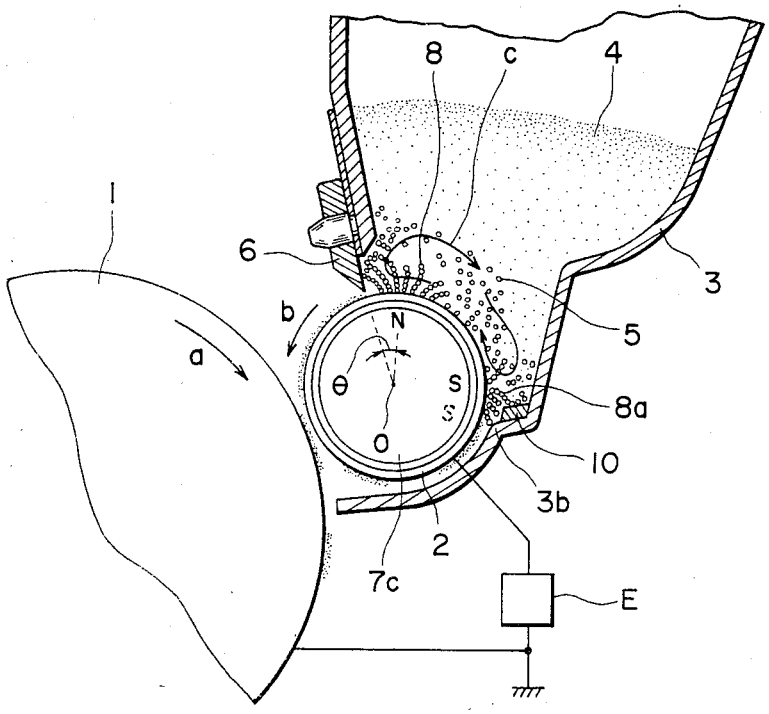
FIG. 4 is a cross-sectional view of a developing apparatus which is one embodiment of the present invention.

An example of the invention will be described with reference to FIG. 4 in which similar parts are denoted by the same reference numerals. In the arrangement of FIG. 4, the photosensitive drum 1 was rotated in the direction of arrow a at a peripheral speed of 60 mm/second. The sleeve 2 was made of stainless steel plate (SUS304) and had an outer diameter of 32 mm and a wall thickness of 0.8 mm. The circumferential surface of the sleeve 2 was subjected to the free sand-blasting by the use of Alundum abrasive grains (#600) to have a roughness of 0.8 μm (Rz=). The sleeve 2 is rotated in the direction of arrow b at a peripheral speed of 66 mm/second.

The rotating sleeve 2 had a ferrite sintering type magnet 7*c* fixed therein which had its first magnetic pole (N pole) angularly spaced away from the magnetic blade 6 toward the upstream of a line connecting the tip of the blade and the center O of the sleeve by an angle of 30 degrees ($\theta_1$)in the direction of movement of the sleeve 2. The other or second magnetic pole (S pole) was positioned substantially right across the sleeve 2 from the magnetic member or iron piece 10 at the entrance of the sleeve 2 into the container 3. The magnetic flux density of the second magnetic pole at the sleeve 2 surface had a peak value of 650 gausses in the presence of the iron piece 10 and a peak value of 400 gausses in the absence of the iron piece 10. At this time, the positional relationship between the second magnetic pole and the iron piece 10 was such that the size of the iron piece in the rotational direction of the sleeve 2 was of 0.5 mm and the spacing between the sleeve 2 and the iron piece 10 was equal to 1.0 mm.

The magnetic blade 6 was made of iron with the surface thereof nickel-plated to prevent rusting. This blade 6 was spaced away from the surface of the sleeve 2 by a distance of 200 μm.

As for the magnetic particles 5, there was used 100 g of spherical ferrite manufactured by Tokyo Denki Kagaku Kogyo K.K. (TDK), having its particle diameter in the range of 70 μm to 100 μm, the maximum 60 emu/g. The non-magnetic developer 4 was 200 g of cyan-colored powder which is chargeable to the negative polarity, this powder consisting of 100 parts of polyester resin, 3 parts of copper phthalocyanine pigment and 5 parts of negative charge control agent (alkyl salicylate metal complex) incorporated therein, and mixed with 0.5% of silica added thereto. The average particle diameter of the powder was equal to 12 μm. The non-magnetic devloper and magnetic particles were sufficiently mingled with each other before they were supplied to the container 3. The circulation of the mixture which was caused particularly by the moving magnetic particles under the influence of the magnetic field during the rotation of the sleeve 2, was observed when the amount of the developer was decreased.

In this developing apparatus, only the non-magnetic developer was formed into a thin layer having a thickness of about 120 μm on the surface of the sleeve 2 during the rotation of the sleeve 2. This developer layer was measured by the blow-off method with respect to charged potential. This showed that the thin layer was uniformly charged to a potential equal to −7 μc/g.

A pattern of charge having a voltage of +600 V at the dark area and a smaller voltage of +150 V at the bright area was formed as an electrostatic latent image on the surface of the photosensitive drum 1 opposed to the sleeve 2. The distance between the sleeve and the drum was set to be equal to 300 μm. When a voltage having a frequency of 800 Hz, a peak-to-peak value of 1.4 KV and a central value of +300 V was applied to the sleeve 2 from a power source E, a high-quality developed image was obtained without non-uniform development, ghost or fog. The development is preferably carried out in accordance with such a process as described in U.S. Pat. No. 4,292,387 or 4,395,476 which has been assigned to the Assignee of the present application.

Among the mixture in the container 3, only the non-magnetic developer was consumed substantially without comsumption of the magnetic particles upon development. The function of development was substantially maintained at the desired level until the developer had substantially been consumed within the container. After the developer had completely been consumed, the developing apparatus was removed from the image forming system and inspected at the portion under of the sleeve 2. Hardly any leakage was found under the sleeve 2 not only with respect to the magnetic particles, but also with respect to the non-magnetic developer. This shows the superior effects of the magnetic brush created under the action of the second magnetic pole, as compared with the case where a single magnetic pole is positioned directly adjacent to the magnetic blade.

Figure 5:
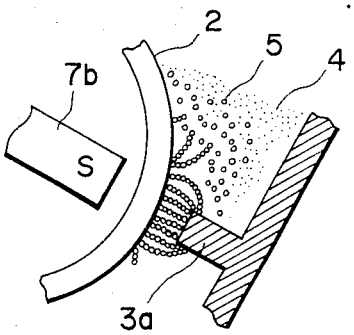
FIG. 5 is a fragmentary section of a modification of the magnetic member relative to the second magnetic pole.

In the present invention, the number of the magnetic poles within the sleeve 2 is not limited to two. The magnetic brush may be formed at any location other than the magnetic member 10. Also, what cooperates with the second magnetic pole to produce the magnetic brush is not limited to a separate magnetic member 10, but it may be a part of the wall 3*b* of the container 3. In such a case, the magnetic member 10 is omitted and the magnetic pole is located at a position as shown by broken line S in FIG. 4. If a magnetic member is used with the second magnetic pole and when the container is of a magnetic material, the magnetic blade 6 and iron piece 10 shown in FIG. 4 may be replaced by the walls of the container. In such a case, the iron piece 10 may be replaced by a protrusion 3*a* extending from the container wall toward the sleeve 2 as shown in FIG. 5. When a separate magnetic member is used with the second magnetic pole for forming a magnetic brush which serves to prevent the developer from leaking out of the container, the magnetic member is not necessarily an iron piece, but it may be a magnet having the opposite polarity to that of the second magnetic pole. The first and second magnetic poles may be in the form of a magnet roller magnetized axially with uni- or bi-polarity or a plurality of rod-like magnets secured on a fixed support.

Figure 6:
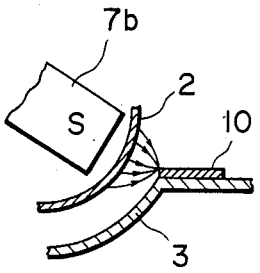
FIG. 6 illustrates the state of a magnetic field on the basis of the relationship between the second magnetic pole and the magnetic member.

Although the second magnetic pole has been described as being S pole, it may be N pole. Additionally, although the regulating member has been described as being in the form of a blade made of the magnetic material such as iron or the like, it may be replaced by a wall- or plate-like member made of a non-magnetic material such as synthetic resins, aluminium, brass, copper, stainless steel or the like. Where a non-magnetic member is used, however, the form of a magnetic brush produced by the magnetic particles within the container is different from that created when the magnetic member is utilized, so that the magnetic particles tend to more easily leak out of the container. This is overcome by setting the gap between the sleeve 2 and the non-magnetic regulating member into a distance smaller than half of the diameter of the magnetic particles. Furthermore, the regulating member may be defined by a portion of the container without providing as a separate member.

Where the magnetic member 10 used with the second magnetic pole is in the form of an iron piece having its rectangular cross-section and if the iron piece has a sharp edge or bur produced upon machining (a cut on the edge) which is opposed to the second magnetic pole, a sharp concentration of magnetic lines of force may be provided, as shown in FIG. 6, to form a magnetic brush of strongly joined magnetic particles with a higher density. Thus, bridges of the magnetic particles will occupy the space between the container 3 and the sleeve 2. Even in such an event, the downward leakage of the developer from the container can effectively be prevented. However, a portion of the developer, returning to the container, which has less electrostatic adhering force to the sleeve 2 is scraped out from the sleeve 2 surface by this strong brush. As a result, such developer is not collected into the container 3 and is accumulated in the bottom of the container 3 such that the developer will be agglomerated into masses by the contact with the sleeve 2 under pressure. These masses of the developer will promote the scraping-out of the developer from the sleeve.

Figure 7:
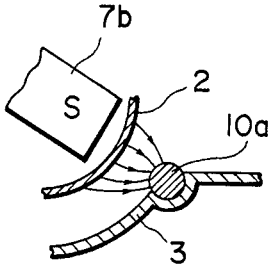
FIG. 7 illustrates the state of a magnetic field when the magnetic member opposed to the second magnetic pole is in the form of an iron wire.

FIG. 7 shows a cross-section of a magnetic member adapted to form such a magnetic brush that can completely collect the developer remaining on the sleeve 2 into the container 3 without formation of such a strong magnetic brush that scrapes the developer out of the sleeve 2 surface. In order to form such a soft structure of the magnetic brush, it is preferable to provide a magnetic member having a curved surface opposed to the sleeve 2 such that the sharp concentration of magnetic lines of force as shown in FIG. 6 is avoided.

In the above arrangement in which the magnetic member has no sharp edge faced to the second magnetic pole in the sleeve 2, the magnetic field can have its gentle gradient along the curved surface of the magnetic member as shown in FIG. 7. In general, the density or strength of a magnetic brush formed by the magnetic particles 5 under the magnetic field depends on the flux density and its gradient of the field. For the prevention of the developer remaining on the sleeve 2 from being scraped out therefrom at the entrance of the sleeve 2 into the container 3, it is preferable to form a relatively rough and soft magnetic brush. By using a magnetic member having its curved surface faced toward the second magnetic pole, therefore, it is possible to form a soft magnetic brush which permits the developer on the rotating sleeve 2 to pass well therethrough and at the same time effectively prevents the developer from leaking out of the container. In other words, such a structure of the magnetic member provides a magnetic brush which smoothly moves along the curved surface of the magnetic member along with the rotation of the sleeve 2 so that the collection of the developer into the container can be promoted, and the leakage of the developer can be prevented.

EXAMPLE

Figure 8:
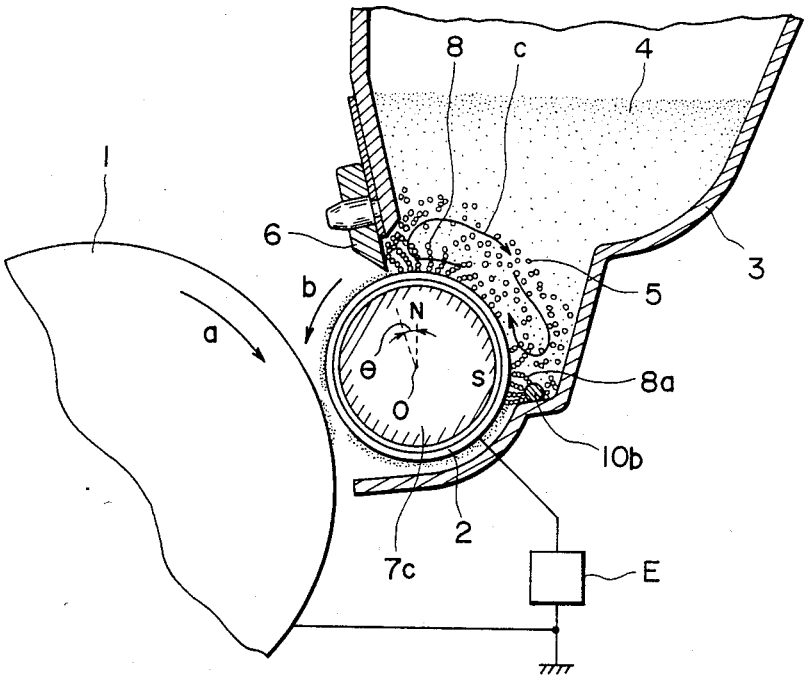
FIG. 8 is a cross-sectional view of a developing apparatus which is one embodiment of the present invention.

Another example of the invention will be described with reference to FIG. 8 in which similar parts are designated by the same reference numerals. In this example, the photosensitive drum 1 is rotated in the direction of arrow a at a peripheral speed of 66 mm/sec. The sleeve 2 is rotated in the direction of arrow b at a peripheral speed of 66 mm/sec. The sleeve 2 was made of stainless steel (SUS304) and had an external diameter of 20 mm and a wall thickness of 0.8 mm. The surface of the sleeve 2 was subjected to the free sand blasting by the use of Alundum abrasive grains (#600) to provide a surface roughness of 0.8 μm (Rz=) in the circumferential direction.

A ferrite sintering type magnet **7*c* was fixedly mounted in the rotating sleeve 2 with the first magnetic pole (N pole) being angularly spaced away from a straight line connecting the tip of the magnetic blade 6 and the center O of the sleeve 2 by an angle of 20 degrees ($\theta_1$). The second pole (S pole) of the magnet was positioned opposed to a steel wire 10*b* which was the magnetic member at the entrance of the sleeve 2 into the container 3. This steel wire was of 1.6 mm diameter and spaced away from the sleeve 2 surface by a distance of 1 mm. The second magnetic pole had its flux density at the sleeve 2 surface which had a peak value of 480 gausses in the presence of the steel wire 10*b* and another peak value of 400 gausses in the absence of the steel wire 10*b***.

The magnetic blade 6 mounted on the container 3 of resin was made of iron or steel and spaced away from the surface of the sleeve 2 by a distance of 300 μm.

The magnetic particles included spherical particle of ferrous material having particle diameters in the range of 44 to 77 μm. The non-magnetic developer was a powder having an average particle diameter of 10 μm and being adapted to be charged into negative polarity, the powder consisting of a mixture which included styrene acrylate resin, copper phthalocyanine pigment and colloidal silica for improving flowability. The magnetic particles 100 g were mixed with the developer 200 g to form a mixture which was in turn supplied into the container.

In the last mentioned arrangement, a thin layer having a thickness of about 120 μm was formed only from the non-magnetic developer on the surface of the sleeve 2 upon rotation thereof. The potential of this developer layer was measured by the use of the blow-off method. The result showed that the thin layer was uniformly charged to a potential of −7 μc/g.

The surface of the photosensitive drum 1, which was faced to the sleeve 2, was caused to have a pattern of charge having a voltage of +500 V at the dark area and a voltage of +50 V at the bright area, which represented an electrostatic latent image. The surface of the photosensitive drum 1 was spaced away from the sleeve 2 surface by a distance of 300 μm. A voltage having a frequency of 800 Hz, a peak-to-peak value of 1.8 KV and a central value of +200 V was applied to the sleeve 2 from a power supply E. As a result, a high-quality developed image was obtained without non-uniformity, ghost and fog.

In respect of the mixture within the container 3, the magnetic particles was substantially not consumed and the non-magnetic developer was consumed upon development. The function of development was substantially maintained at the desired level until the developer had been consumed in the mixture. At this time, the developing apparatus was removed out of the machine and inspected at the bottom thereof. There was no leakage not only with respect to the magnetic particles, but also with respect to the developer.

On the contrary, the steel wire **10*b* was replaced by an iron piece having a rectangular cross-section of 2 mm×4 mm as shown in FIG. 2. This iron piece had been sharpened and made to have some burs or flashes formed thereon at the side of the sleeve 2 by the use of a file and was spaced away from the sleeve 2 by a distance of 1 mm. When the developer was consumed in the container, the developing apparatus was removed out of the machine and inspected visually. There was observed the developer accumulated on the bottom wall of the sleeve 2**.

The magnetic member in the form of steel wire may preferably have a diameter of 0.5 mm to 3 mm. This is so, because there was the lower limit to prevent the developer from scraping out from the sleeve 2, and there was the upper limit to prevent the developer from leaking at the second magnetic pole, when the apparatus was vibrated.

Figure 9:
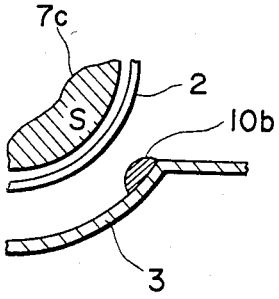
FIGS. 9 to 11 are fragmentary sections of modifications of the magnetic member located opposed to the second magnetic pole.
Figure 10:
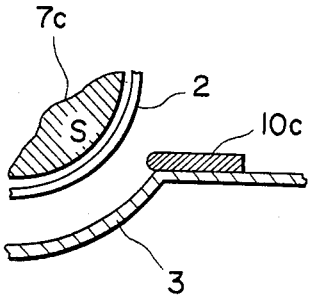
Figure 11:
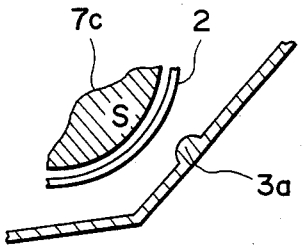

In accordance with the present invention, the number of the magnetic poles within the sleeve 2 is not limited to two, as described hereinbefore. Although FIG. 7 shows the magnetic member having its circular cross-section, there can be used a magnetic member having its semi-circular cross-section as shown in FIG. 9 or an iron piece having a rounded tip faced to the magnetic pole as shown in FIG. 10. If the container 3 is made of a magnetic material, the magnetic blade 6 and iron piece **10*b* shown in FIG. 8 may be replaced by the walls of the container 3. In such a case, the iron piece may be replaced by a projection 3*a* extending from the container 3 wall toward the sleeve 2 as shown in FIG. 11**.

Although the second magnetic pole is shown to be S pole, it is of course that the pole may be of N polarity. Also, although the regulating member is shown to be the magnetic blade, it may be of a wall- or plate-like member which is made of any other suitable non-magnetic material such as synthetic resin, aluminium, brass, stainless steel or the like. This non-magnetic blade will be described further in detail hereinafter.

In the developing apparatus shown in FIG. 1, the range in which the magnetic brush formed by the magnetic particles 5 is circulated in the container 3 is rather restricted, since a single magnetic pole is used for the mixture of the developer 4 and the magnetic particles 5 in the container 3. If a number of latent images having high potential are continuously developed so as to consume an increased amount of the developer onto the sleeve 2, the amount of the developer within the magnetic brush 8 can become insufficient, leading to non-uniform development.

To overcome such a problem, the present invention provides the following embodiment in which a magnetic pole having the same polarity as that of the magnetic pole S in FIG. 1 is positioned upstream in the direction of movement of the sleeve 2 and in a range within which the magnetic field is effective.

Figure 12:
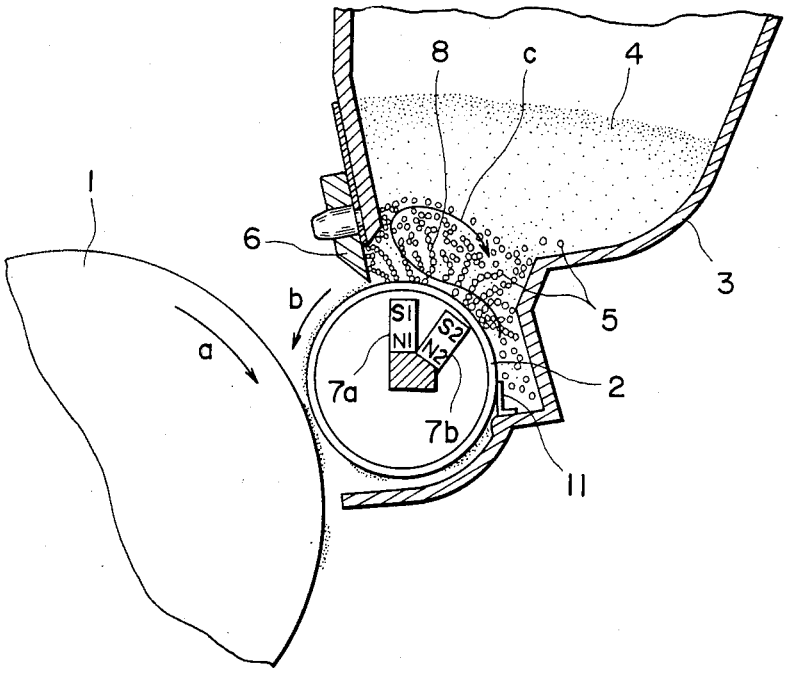
FIGS. 12 and 13 are cross-sectional views of developing apparatuses to which the present invention is applied.

This embodiment is shown in FIG. 12 in which similar parts are denoted by the same reference numerals.

Referring to FIG. 12, there is shown a first fixed magnet **7*a* which defines a first magnetic pole $S_1$ and which serves to perform the same function as that of the magnet 7 in FIG. 1, that is, to form a magnetic brush adjacent to the magnetic blade 6. A second magnet 7*b* is also provided to provide a second fixed magnetic pole $S_2$. This second magnet 7*b* has its magnetic pole of the same polarity (S) as that of the first magnetic pole and which is positioned to the sleeve 2**. In such an arrangement, a repelling magnetic field is created between the first and second magnetic poles. Accordingly, magnetic brushes produced by the magnetic particles under the influence of the respective magnetic poles can have increased width so that the non-magnetic particles is more effectively be moved into the magnetic brushes. Even if an increased amount of the developer is consumed for development, the developer can be sufficiently supplied to the magnetic brushes such that the creation of non-uniform development caused by insufficient developer supply can be avoided effectively.

The configuration of the above repelling magnetic poles $S_1$ and $S_2$ may well be such that the formed magnetic brushes formed between the poles has the increased width under the influence of the repelling magnetic field. If the repelling magnetic field is too strong, the smooth circulation of the magnetic particles is disturbed. The distance and angle between the first and second magnetic poles are determined depending on the flux density of each of the magnetic poles, the ratio of mixture of the magnetic particles and the developer, the peripheral speed of the sleeve 2 and so on, such that a preferred repelling magnetic field will be formed therebetween. The magnetic brush, which has been formed with the magnetic particles under the influence of the magnetic field as shown in FIG. 12, moves against the wall of the container 3 at the exit side and travels upwardly to circulate as shown by arrow c as the sleeve 2 is being rotated.

In this connection, if two or more magnetic poles having different polarities are arranged side-by-side, magnetic brushes can easily move on the sleeve 2 surface to produce an excessive circulation of the magnetic particles such that the developer will excessively be charged or only the magnetic particles will be circulated in the magnetic brushes. This tends to prevent the smooth catching of the developer into the magnetic brushes.

When it is probable that the developer leaks out of the container 3 at the entrance of the sleeve 2, an anti-leakage member 11 made of a resin film may be mounted on the container as shown in FIG. 12. Upon development, a DC bias voltage may effectively be applied to the sleeve 2 in place of the alternating voltage.

EXAMPLE

Figure 13:
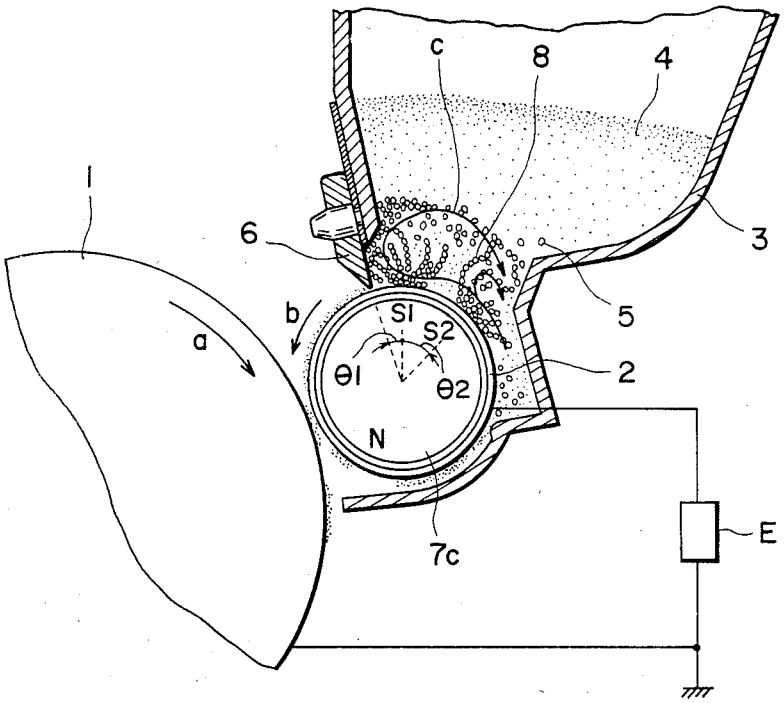

Still another example of the present invention will be described with reference to FIG. 13 in which similar parts are designated by the same reference numerals. In this example, the photosensitive drum 1 is rotated in the direction of arrow a at the peripheral speed of 66 mm/sec. The sleeve 2 is rotated in the direction of arrow b at the peripheral speed of 60 mm/sec. The sleeve 2 was made of stainless steel (SUS304) and had an external diameter of 32 mm and a wall thickness of 0.8 mm. The circumferential surface of the sleeve 2 had a surface roughness of 0.8 μm (Rz) which was formed by the free sand blasting using Alundum abrasive grains (#600).

The sleeve 2 contained a ferrite sintering type magnet *7c* with the first magnetic pole ($S_1$ pole) thereof being angularly spaced relative to the magnetic blade 6 by an angle of 25 degrees ($\theta_1$). The second magnetic pole ($S_2$ pole) of the magnet *7c* was angularly spaced relative to the $S_1$ pole by an angle of 40 degrees ($\theta_2$). The above $S_1$ pole had its flux density at the sleeve 2 surface which has a peak value of 800 gausses in the presence of the magnetic blade 6, and a peak value of 600 gausses in the absence of the blade 6. The $S_2$ pole had the peak value of 700 gausses.

The magnetic blade 6 was made of iron and nickel-plated at the surface thereof for preventing rusting. The magnetic blade 6 was positioned at a location spaced away from the surface of the sleeve 2 by a distance of 250 μm.

The magnetic particles 5 included spherical ferrite particles having its particle diameter in the range of 80 μm to 105 82 m, the maximum 62 emu/g, which were available from TDK company. On the other hand, the non-magnetic developer 4 consisted of 100 parts of polyester resin, 3 parts of copper phthalocyanine pigment and 5 parts of negative charge control agent (alkyl salicylate metal complex) incorporated therein and was added by 0.6% of silica. This developer was in the form of cyan-colored powder which was adapted to be charged into negative polarity and had its average particle diameter of 12 μm. The magnetic particles 100 g and the non-magnetic developer 200 g were mixed with each other and then contained in the container 3. The mixture of the magnetic particles and the non-magnetic developer was moved and circulated in the direction of arrow while forming magnetic brushes having their increased width by the repelling magnetic field created by the composite magnetic line of force from the magnetic poles, as the sleeve 2 was being rotated.

During the rotation of the sleeve 2, a developer layer having a thickness of about 120 μm was formed on the surface of the sleeve 2 and measured by the blow-off method with respect to its charge potential. The result showed that the developer layer was uniformly charged into a potential of −7 μc/g.

A pattern of charge having a voltage of +500 V at the dark area and a voltage of +50 V at the bright area was formed as an electrostatic latent image on the surface of the photosensitive drum 1 opposed to the sleeve 2. The drum surface was spaced away from the sleeve 2 surface by a distance of 300 μm. When a voltage having a frequency of 800 Hz, a peak-to-peak value of 1.8 KV and a central value of +200 V was applied to the sleeve 2 from the power source E, a high-quality developed image could be obtained without non-uniform development, ghost and fog. The magnetic particles in the mixture contained within the container 3 was substantially not consumed and only the non-magnetic developer was consumed. The function of development was substantially maintained at the desired level until the developer had completely be consumed in the container.

In accordance with the present invention, the number of the magnetic poles having the same polarity is not limited to two.

Figure 14A:
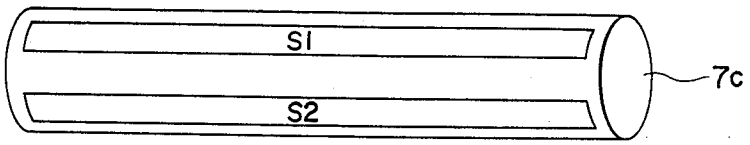
FIGS. 14A, B and C are plan views showing magnet rollers having different patterns of magnetic pole.
Figure 14B:
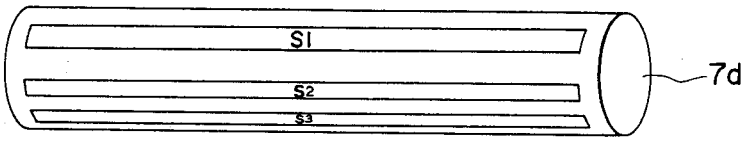
Figure 14C:
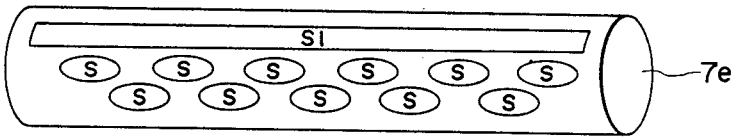

FIGS. 14A to 14C illustrate various different configurations of the magnetic poles. FIG. 14A shows just the same configuration as that of the magnet *7c* shown in FIG. 13, FIG. 14B shows a magnet *7d* having three magnetic poles $S_1$, $S_2$ and $S_3$, and FIG. 14C shows a magnet *7e* having a plurality of separate magnetic poles which will not be positioned opposed to the magnetic blade.

In connection with the magnetic field formed on the sleeve 2 by the repelling magnetic poles, the flux density between the magnetic poles having the same polarity is not necessarily required to be zero gauss as far as the resulting magnetic brushes have their width larger than that of a single magnetic pole. If the density in the magnetic brushes formed by the magnetic particles under the influence of the repelling magnetic field is low, the developer may well be caught by the magnetic brushes. In accordance with the present invention, it is made possible to prohibit the high speed circulation of the magnetic particles which would be created where the magnetic poles having different polarities are arranged side-by-side, to stabilize the form of the magnetic brushes and to prevent the excessive stir of the developer.

Although the magnetic pole adjacent to the container 3 has been described to be S pole, this may be N pole. Although the regulating member has been described to be in the form of a magnetic blade, it may be replaced by a wall- or plate-like member made of a non-magnetic material such as synthetic resin, aluminium, brass, stainless steel or the like.

If the regulating member is made of a magnetic material such as iron or the like, there will be created a strong concentration of the magnetic field between the regulating member 6 and the magnet 7. As a result, the magnetic particles existing between the regulating member and the magnet tends to be prohibited in circulative and rotational movement under the influence of the strong magnetic force. In such a state, the non-magnetic developer will less be caught by the magnetic brushes and insufficiently triboelectrically charged resulting in non-uniform development due to the developer application irregularity.

When latent images having a high potential are continuously developed to consume an increased amount of the developer on the sleeve 2, the developer will be insufficient within the magnetic brush 8 resulting in non-uniform development. When the magnetic blade is used, the magnetic particles to be circulated in the magnetic field concentrated at the tip of the regulating member tends to be compacted into the gap between the regulating member and the sleeve 2 surface without upward movement. This causes an irregularity of application of the developer onto the sleeve 2. Further, the surface of the sleeve 2 may have a circumferential localized score or degradation.

In order to overcome such a problem, the present invention provides the following embodiment in which a magnetic pole (S pole) is located upstream in the direction of movement of the sleeve 2 at the exit end of the container and within such an extent that the magnetic field influences in the container 3.

Figure 15:
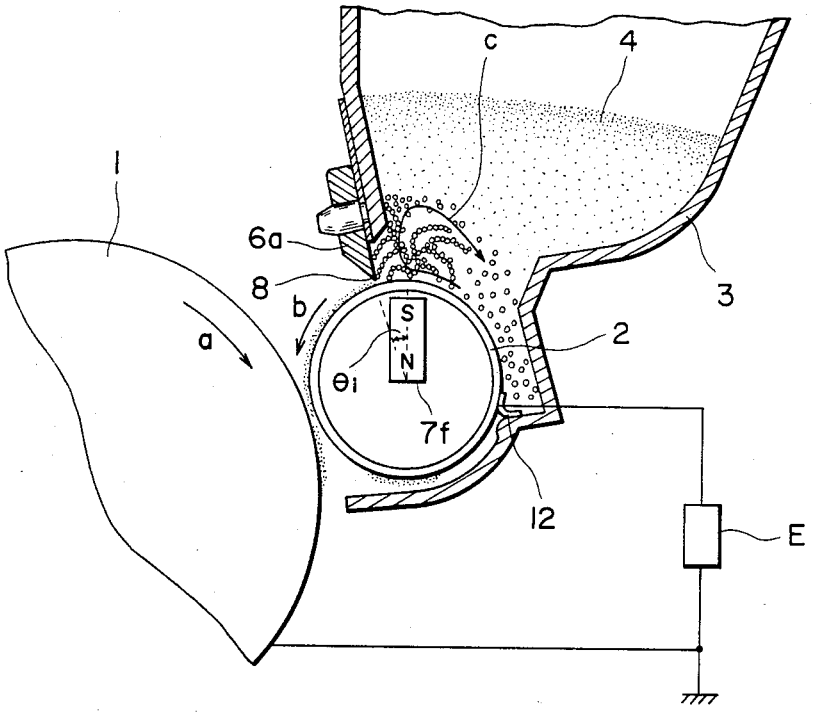
FIG. 15 is a cross-sectional view of a developing apparatus which is one embodiment of the present invention.

This embodiment is illustrated in FIG. 15 in which similar parts are designated by the same reference numerals.

Referring to FIG. 15, there is shown a fixed magnet *7f* for providing a magnetic pole S which performs the same function as that of the magnet 7 shown in FIG. 1, that is, to form a magnetic brush positioned adjacent to the non-magnetic blade *6a* and upstream in the direction of movement of the sleeve 2. In such an arrangement, there is no concentration of the magnetic field between the non-magnetic blade *6a* and the magnet *7f*, which would otherwise be created if the blade is magnetic. Thus, the magnetic particles can sufficiently be circulated and rotated substantially throughout the width of the container 3 opening. Also, the width of the magnetic brush may be increased so that the catching of the non-magnetic developer by the magnetic brush will be improved. Even if an increased amount of the developer is consumed on development, the developer can sufficiently be supplied to the magnetic brush to prevent non-uniform development.

The magnetic particles 5 forming the magnetic brush 8 can not leak on the sleeve 2 from the container 3 by setting the restraint force under the magnetic field of the magnet *7f* such that it is larger than the conveying force under friction, and by setting the gap produced between the surface of the sleeve 2 and the non-magnetic blade *6a* such that it is substantially several times the average particle diameter in the magnetic particles or less and also larger than the particle diameter of the developer, preferably substantially equal to the average particle diameter of the magnetic particles.

It is of course that the above setting of the gap is determined not only by the particle diameters of the magnetic particles, but also depending upon the flux density of the magnetic pole, the magnetic property of the magnetic particles, the ratio of the magnetic particles to the developer in the mixture, the differential flowability due to the different materials, the peripheral speed of the sleeve 2, the roughness of the surface of the sleeve 2 and so on. The angle included between the sleeve 2 and the blade also is determined similarly depending on various conditions.

EXAMPLE

A further example of the present invention will now be described with reference to FIG. 15. In this example, the photosensitive drum 1 is rotated in the direction of arrow a while the sleeve 2 is rotated in the direction of arrow b. The sleeve 2 was made of stainless steel (SUS304) and had an external diameter of 32 mm and a wall thickness of 0.8 mm. The circumferential surface of the sleeve had a surface roughness of 0.8 μm (Rz=) which was provided by the free sand blasting using Alundum abrasive grains (#600).

A ferrite sintering type magnet *7f* was fixedly mounted in the sleeve 2 with the magnetic pole (S pole) being angularly positioned relative to the non-magnetic blade *6a* by an angle of 25 degrees ($\theta_1$). The flux density of the S pole at the sleeve 2 surface was 600 gausses. The non-magnetic blade *6a* was made of stainless steel (SUS304) and spaced away from the surface of the sleeve 2 by 100 μm.

The magnetic particles 5 included spherical ferrite particles having particle diameters in the range of 80 μm to 106 μm, the maximum 62 emu/g, which was available from TDK. The non-magnetic developer 4 is in the form of cyan-colored powder which is chargeable into negative polarity and which has an average particle diameter equal to 12 μm. The powder consisted of 100 parts of polyester resin, 3 parts of copper phthalocyanine pigment, and 5 parts of negative charge control agent (alkyl salicylate metal complex) incorporated therein, and was added by 0.6% of silica. The non-magnetic developer 200 g and the magnetic particles 80 g were mixed with each other and contained in the container 3. During the rotation of the sleeve 2, the mixture moved and circulated in the direction of arrow while forming a magnetic brush having its increased width under the influence of the magnetic field created by the magnetic lines of force from the magnetic pole.

As the sleeve was being rotated, a developer layer having a thickness equal to about 80 μm was formed on the surface of the sleeve 2 and measured by blow-off method with respect to charge potential. The result showed that the developer layer was uniformly charged into a potential equal to −7 μc/g.

A pattern of charge having a voltage of +500 V at the dark area and a voltage of +50 V at the bright area was formed as an electrostatic latent image on the surface of the photosensitive drum 1 opposed to the sleeve 2. The surface of the sleeve 2 was spaced away from the drum 1 surface by a distance equal to 300 μm. When a voltage having a frequency of 800 Hz, a peak-to-peak value of 1.4 KV and a central value of +200 V was applied to the sleeve 2 from the power source E, a high-quality developed image was obtained without non-uniform development ghost and fog. In connection with the mixture within the container 3, the magnetic particles was substantially not consumed while merely the non-magnetic developer was consumed on development. Further, the function of development was substantially maintained at the desired level until the developer had substantially be consumed in the container.

In accordance with the present invention, the number of the magnetic pole is not limited to one. A plurality of N and S poles as conveying poles may alternately be located upstream of the S pole. The tip form of the regulating blade may have a flat face parallel to the surface of the sleeve 2 rather than the sharp edge.

In such an arrangement, there is no concentration of the magnetic field toward the regulating member. If the density of the magnetic brush is moderately low, the developer can more effectively be caught by the magnetic brush. In accordance with the present invention, furthermore, it is possible to prohibit the high speed circulation of the magnetic particles which would be created if the magnetic poles having different polarities are arranged side-by-side, to stabilize the configuration of the magnetic brush and to prevent the excessive agitation of the developer.

Although the magnetic pole has been described to be S pole adjacent to the container in the example shown in FIG. 15, it may be replaced by N pole. The regulating member may be an extension of the non-magnetic container made of aluminium, hard synthetic resin material or the like, rather than a separate part. If it is probable that the developer leaks out of the container at the entrance of the sleeve 2 thereinto, an anti-leakage member 12 made of a film-like material may be mounted on the container as shown in FIG. 15. In accordance with the present invention, the magnetic particles may be of any suitable magnetic material such as iron powder (which has been used as a developer in the prior art), ferrite, their bonded body with adhesive, or the like. The non-magnetic developer may be one of the electrophotographic developers in the prior art, for example, a pulverized or capsuled resin kneaded with any suitable dye or pigment.

The image bearing member may be of any suitable type, for example, a drum- or belt-like member having a photosensitive and or insulation layer. The rotating developer carrier may be in the form of a sleeve made of any suitable non-magnetic material such as aluminium, copper, stainless steel, brass, synthetic resin or the like, or an endless belt made of any suitable metallic or resin material. The circumferential surface of the carrier may be roughed or embossed to improve the conveyance and chargeability of the toner. Furthermore, the development may be carried out by the use of a DC voltage, an alternative voltage or an alternative voltage superposed by the DC voltage. The development may be also carried out by known process, contact or non-contact process.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus wherein a thin layer of a non-magnetic developer is formed, comprising in combination:

a developer container for containing non-magnetic developer and magnetic particles;

a developer carrying member movable for carrying the non-magnetic developer toward an image bearing member and then back to said developer container;

regulating means disposed adjacent to a non-magnetic developer outlet of said developer container with a clearance with respect to a surface of the developer carrying member;

magnetic field generating means having a magnetic pole disposed across said developer carrying member from said regulating means; and a magnetic sealing member for preventing leakage of the non-magnetic developer disposed adjacent to the returning developer inlet of said developer container with a clearance with respect to a developer carrying surface of said developer carrying member, and disposed within a magnetic field of said magnetic field generating means;

wherein said regulating means and said magnetic field generating means cooperate to confine the magnetic particles within said developer container to apply the non-magnetic developer on said developer carrying member.

2. An apparatus according to claim 1, wherein said regulating means includes a magnetic blade of a magnetic material.

3. An apparatus according to claim 1 or 2, wherein said magnetic field generating means includes an additional magnetic pole, and wherein said magnetic member is disposed across said developer carrying member from said additional magnetic pole.

4. An apparatus according to claim 3, wherein said magnetic member is upstream of said additional magnetic pole with respect to the movement of said developer carrying member.

5. An apparatus according to claim 3, wherein said magnetic member is right across said developer carrying member from said additional magnetic pole.

6. An apparatus according to claim 3, wherein said magnetic member is a magnet.

7. An apparatus according to claim 3, wherein said magnetic member is a projection of said developer container made of a magnetic material.

8. An apparatus according to claim 3, wherein said magnetic member has a curved surface facing toward said additional magnetic pole.

9. An apparatus according to claim 8, wherein said magnetic member is a steel wire.

10. An apparatus according to claim 7, wherein the projection has a curved surface.

11. An apparatus according to claim 1, wherein said regulating member includes a blade of non-magnetic material.

12. An apparatus according to claim 1, 2 or 11, wherein a thin layer of the non-magnetic developer formed on said developer carrying member is opposed to the latent image bearing member with a clearance therebetween at a developing zone whereat said latent image bearing member and said developer carrying member are opposed.

13. An apparatus according to claim 12, wherein an alternating voltage is applied between said image bearing member and said developer carrying member.

14. An apparatus according to claim 13, wherein said developer carrying member has a rough surface.

15. A developing apparatus wherein a thin layer of a non-magnetic developer is formed, comprising in combination:

a developer container for containing non-magnetic developer and magnetic particles;

a sleeve rotatable for carrying the non-magnetic developer toward an image bearing member and then back to said container;

a magnetic blade, disposed adjacent to a non-magnetic developer outlet of said developer container with a clearance with respect to a surface of the sleeve;

a magnet, disposed across said sleeve from said magnetic blade and upstream of said magnetic blade with respect to movement of said sleeve; and a magnetic sealing member disposed on the developer carrying side of said sleeve for preventing leakage of the non-magnetic developer at an inlet, for the returning developer, of said developer container;

wherein said magnetic blade and said magnet cooperate to confine the magnetic particles within said developer container to apply the non-magnetic developer on said rotatable sleeve.

16. A developing apparatus wherein a thin layer of a non-magnetic developer is formed, comprising in combination:

a developer container for containing non-magnetic developer and magnetic particles;

a developer carrying member movable for carrying the non-magnetic developer toward an image bearing member and then back to said developer container;

regulating means disposed adjacent to a non-magnetic developer outlet of said developer container with a clearance with respect to a surface of the developer carrying member;

magnetic field generating means having magnetic poles of the same polarity for forming a repelling magnetic field, said magnetic field generating means being disposed across said developer carrying member from said regulating means and upstream of said regulating means with respect to movement of said developer carrier member;

a sealing member disposed on the developer carrying side of said developer carrying member for preventing leakage of the non-magnetic developer at an inlet, for the returning developer, of said developer container;

wherein said regulating means and said magnetic field generating means cooperate to confine the magnetic particles within said developer container to apply the non-magnetic developer on said developer carrying member.

17. An apparatus according to claim 16, wherein said regulating means includes a magnetic blade of a magnetic material.

18. An apparatus according to claim 16 or 17, wherein the number of said magnetic poles is three.

19. An apparatus according to claim 16 or 17, wherein said magnetic poles are provided by a number of independent magnetic poles.

20. A developing apparatus wherein a thin layer of a non-magnetic developer is formed, comprising in combination:

a developer container for containing non-magnetic developer and magnetic particles;

a developer carrying member movable for carrying the non-magnetic developer toward an image bearing member and then back to said developer container;

a non-magnetic blade disposed adjacent to a non-magnetic developer outlet of said developer container with a clearance with respect to a surface of the developer carrying member;

magnetic field generating means having a magnetic pole disposed across said developer carrying member from said non-magnetic blade and upstream of said non-magnetic blade with respect to movement of said developer carrier member;

sealing member disposed on the developer carrying side of said developer carrying member for preventing leakage of the non-magnetic developer at an inlet, for the returning developer, of said developer container;

wherein said non-magnetic blade and said magnetic field generating means cooperate to confine the magnetic particles within said developer container such that substantially only non-magnetic developer is withdrawn from said container for development.

* * * * *

UNITED STATES PATENT AND TRADEMARK OFFICE

CERTIFICATE OF CORRECTION

PATENT NO. : 4,563,978

DATED : January 14, 1986

INVENTOR(S) : Nakamura et al.

It is certified that error appears in the above-identified patent and that said Letters Patent is hereby corrected as shown below:

Column 1, line 66, change "there-from" to --therefrom--.

Column 5, line 46, change "$(\theta_1)$in" to --$(\theta_1)$ in--.

Column 6, line 39, change "comsumption" to --consumption--.

Column 10, line 27, change "effectively be moved" to --effectively moved--.

Column 11, line 34, change "105 82 m," to --105 $\mu$m--.

Column 12, line 5, change "be consumed" to --been consumed--.

Column 14, line 38, change "be consumed" to --been consumed--.

Column 18, line 16, change "sealing member" to --a sealing member--.

Signed and Sealed this

Twenty-first Day of October, 1986

[SEAL]

*Attest:*

DONALD J. QUIGG

*Attesting Officer*

*Commissioner of Patents and Trademarks*